United States Patent [19]

Kusko et al.

[11] Patent Number: 4,853,598

[45] Date of Patent: Aug. 1, 1989

[54] FLUORESCENT LAMP CONTROLLING

[75] Inventors: Alexander Kusko, 161 Highland Ave., Needham Heights, Mass. 02194; Noshirwan K. Medora, South Attleboro, Mass.

[73] Assignee: Alexander Kusko, Weston, Mass.

[21] Appl. No.: 108,137

[22] Filed: Oct. 13, 1987

[51] Int. Cl.[4] ..... H05B 41/36

[52] U.S. Cl. ..... 315/101; 315/DIG. 4; 315/DIG. 7; 315/291; 315/209 R

[58] Field of Search ..... 315/DIG. 4, DIG. 7, 315/DIG. 5, 97, 224, 101-105, 106, 219, 107, 101, 274, 244, 209 R, 291, 174

[56] References Cited

U.S. PATENT DOCUMENTS

| | | | |
|---|---|---|---|
| 4,353,009 | 10/1982 | Knoll | 315/DIG. 4 |
| 4,370,600 | 1/1983 | Zansky | 315/DIG. 4 |
| 4,392,086 | 7/1983 | Ide et al. | 315/DIG. 4 |
| 4,392,087 | 7/1983 | Zansky | 315/DIG. 4 |
| 4,441,054 | 4/1984 | Bay | 315/DIG. 4 |
| 4,463,286 | 7/1984 | Justice | 315/DIG. 4 |
| 4,492,899 | 1/1985 | Martin | 315/DIG. 7 |
| 4,513,364 | 4/1985 | Nilssen | 315/DIG. 4 |
| 4,588,924 | 5/1986 | Luursema et al. | 315/DIG. 5 |
| 4,663,570 | 5/1987 | Luchaco et al. | 315/279 |
| 4,682,080 | 7/1987 | Ogawa et al. | 315/DIG. 4 |
| 4,686,427 | 8/1987 | Burke | 315/DIG. 4 |

*Primary Examiner*—David K. Moore
*Assistant Examiner*—Michael Razavi
*Attorney, Agent, or Firm*—Charles Hieken

[57] ABSTRACT

An apparatus for energizing a fluorescent lamp having two filament electrodes. The apparatus comprises a rectifier circuit responsive to an AC voltage for providing DC voltage and a transformer having at least a primary winding and a secondary winding for providing transformed power to said lamp. A switch intermittently connects said DC voltage to said primary winding to develop current pulses at an ultrasonic frequency. Said secondary winding is coupled to said filament electrodes to both heat said filament electrodes and establish a potential thereacross for initiating and maintaining an arc therebetween.

5 Claims, 2 Drawing Sheets

FLUORESCENT LAMP CONTROLLING

Figure 1:
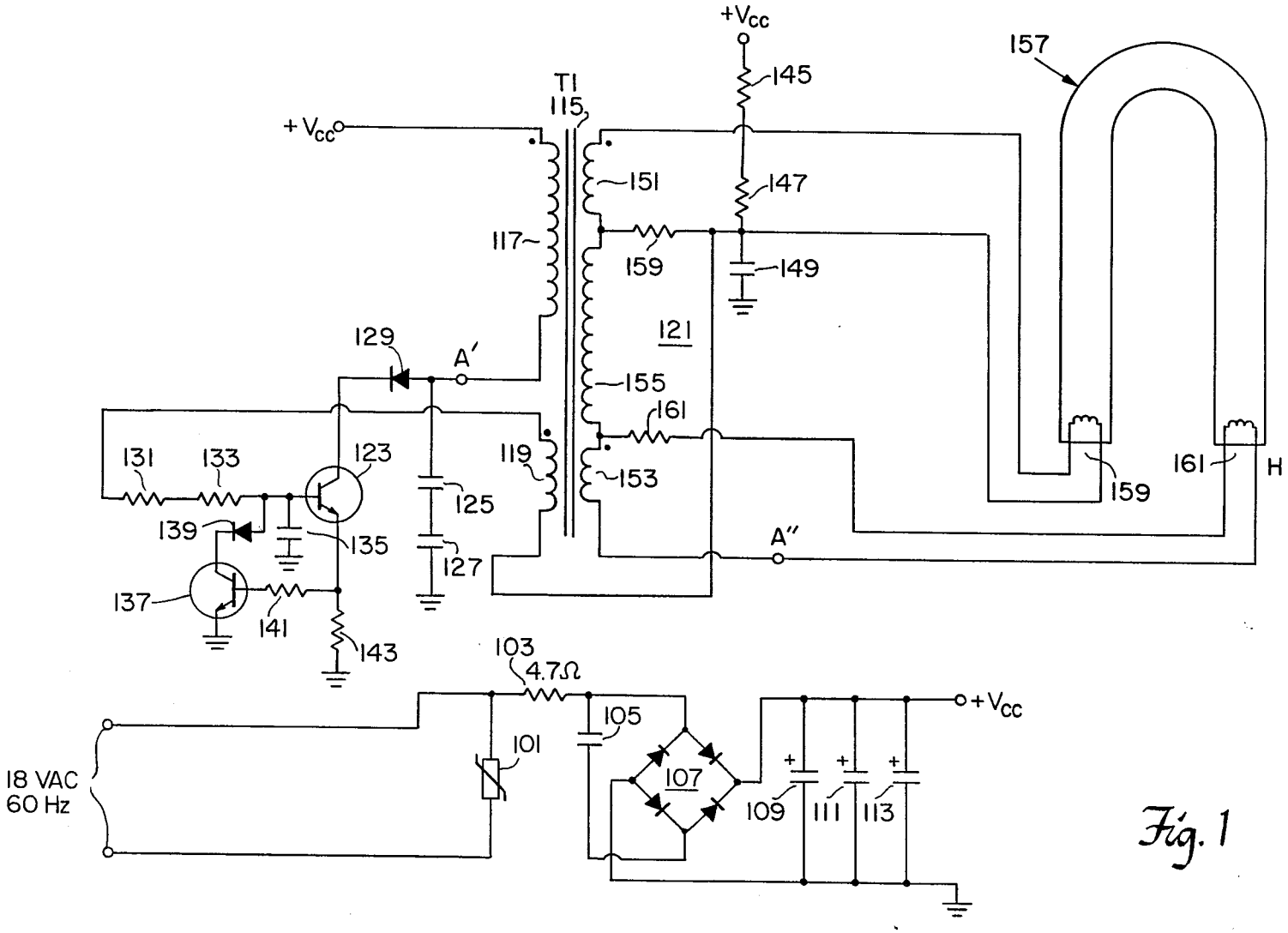

This invention relates to a circuit for a dimmable fluorescent lamp and more specifically, a low wattage fluorescent lamp.

A fluorescent lamp is a low power gas discharge lamp whose light output is produced by exciting phosphors. The lamp is usually in the form of a long tubular bulb, and has a filament electrode in each end. The glass bulb contains mercury vapor at low pressure, with a small amount of inert gas for starting. The inner surface of the bulb is coated with fluorescent phosphors. The filament is generally constructed of tungsten wire coated with a mixture of alkaline earth oxides. When a potential is applied between the electrodes through a transformer from a 60 Hz, 120 VAC line, a mercury arc is produced by the flow of current between the filament electrodes. The mercury arc generates ultraviolet radiation which excites the phosphors and produces visible light.

Most low wattage fluorescent lamps comprise a starter and an RF suppression capacitor, which is plugged into a receptacle having an integral or separate ballast inductor. The starter consists of a glass bulb filled with an inert gas and two contact electrodes, a fixed contact and a bimetallic movable contact. When the lamp switch is closed, the line voltage provides a glow discharge between the contacts which heats the bimetallic strip and forces the contacts to close. When the contacts close, the power circuit is completed through the lamp filaments. This causes a current in the filament windings which heats the lamp filaments. Since the voltage across the closed contacts is zero, there is no glow discharge and the bimetallic element cools. As the element cools, the contacts open and impress an inductive spike across the fluorescent lamp which initiates the mercury arc discharge. Once the mercury arc is established, the applied voltage across the starter is insufficient to produce a starter glow, and the starter remains off.

The ballast inductor is used to perform several functions such as to limit the filament current when the lamp is turned on, provide an inductive voltage to ignite the lamp, and to limit the lamp current to a safe value after the lamp has been ignited. The inductor also provides a voltage peak on each half cycle to re-ignite the lamp.

A general feature of the invention is that a solid state fluorescent lamp circuit is used to power a fluorescent lamp. The circuit comprises a rectifier circuit responsive to an AC voltage line for generating a DC voltage supply. A transformer has at least a primary and a pair of secondary winding portions. An oscillating circuit in series with the primary winding establishes a high frequency current in the primary winding to provide the necessary ignition voltages across the secondary windings to establish and maintain the mercury arc discharge in the bulb of the lamp.

Preferred embodiments of the invention include the following features. The oscillator circuit comprises a power transistor coupled to the primary winding for providing a voltage waveform having peaks during every cycle which provide the potential between the filament electrodes for igniting the lamp. A snubber circuit connected in parallel with the power transistor limits the maximum voltage applied to the power transistor. A blocking diode connected between the power transistor and the snubber circuit forces the oscillating frequency to be primarily determined by the inductance of the transformer and the capacitance of the snubber circuit.

In another preferred embodiment, a resonant circuit between the transformer and the filament electrodes produces a potential greater than the potential produced across a secondary winding for igniting the lamp. In this embodiment, the oscillator circuit comprises a power MOSFET used as an on and off switch for oscillating the applied potential at the secondary winding. The MOSFET is operated by a CMOS oscillator circuit set to a predetermined frequency. A snubber circuit limits the peak voltage across the MOSFET.

There are several advantages of the present invention. The circuit requires no bimetallic starter as in conventional fluorescent lamp circuits and has a relatively high power factor. The lamp operating frequency is in excess of 30 kHz, well above the audible range, and permits the use of smaller magnetic components. The higher frequency also results in an increased lamp efficiency as compared to the operation at the 60 Hz line frequency. Dimming of the fluorescent lamp is performed by a simple reduction of the input line voltage. The lamp filament current which is at full value during the lamp starting is reduced during normal running to maintain high electrical efficiency. Also, unlike the inductor ballast fluorescent lamp which has two separate assemblies, this solid state fluorescent lamp circuit may be a one-piece unit with the fluorescent lamp an integral part of the circuit assembly. As a result, a small compact unit may be assembled.

Figure 2:
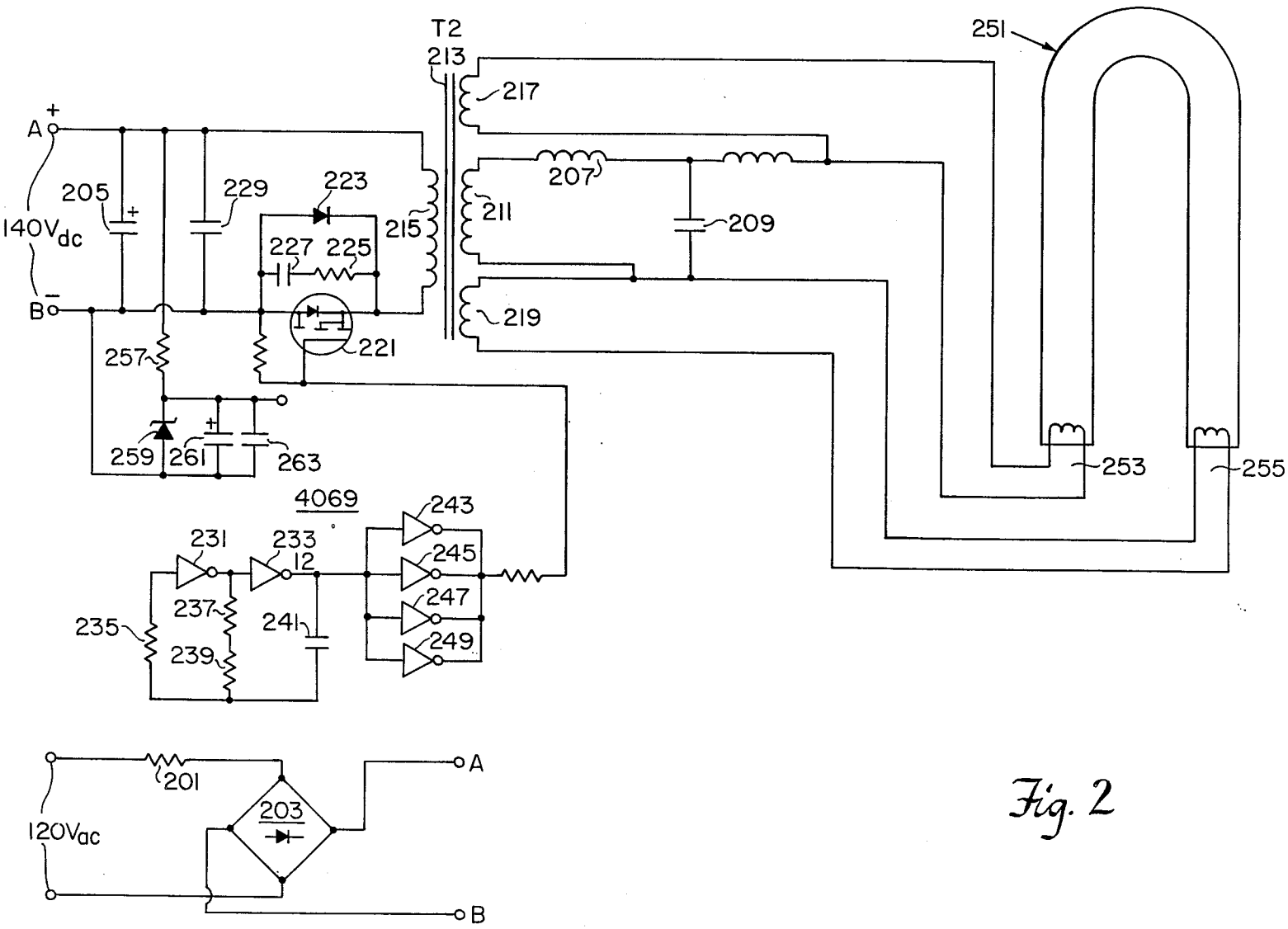

Other advantages and features will become apparent from the following specification when read in connection with the accompanying drawings in which:

FIG. 1 is a circuit diagram illustrating a blocking-oscillator dimmable fluorescent lamp; and FIG. 2 is a circuit diagram illustrating a resonant circuit dimmable fluorescent lamp.

With reference to the drawing and more particularly FIG. 1 thereof, there is shown a circuit diagram of a low-wattage fluorescent lamp using a modified blocking oscillator circuit powered by a conventional full-wave bridge rectifier circuit.

AC voltage from a common 60 Hz, 120 VAC outlet is applied to the input stage of the rectifier circuit to produce a DC output voltage. The input stage of the rectifier circuit comprises a transient suppressor 101, a series resistor 103, and a high frequency bypass capacitor 105. The full-wave bridge rectifier 107 rectifies the input AC voltage, and filter capacitors 109, 111 and 113 filter the AC ripple voltage to produce a smooth DC output voltage, which is proportional to the input AC voltage (typically 145 VDC). The transient suppressor 101 limits the input transient voltage. The series resistor 103 limits the current surge into the input filter capacitors when the lamp is turned on and also helps in decreasing the ripple factor in the output waveform. A high frequency bypass capacitor 105 in conjunction with the series resistor 103 attenuates the high frequency AC noise. The generated DC voltage across the filter capacitors supplies electric power to the modified blocking oscillator circuit.

In principle, the blocking oscillator circuit comprises a solid-state switch that switches current to primary winding 117 on and off. The blocking oscillator circuit and associated transformer provide the starting and operating lamp voltages and current for heating the filament electrodes. The circuit provides an assymmetrical voltage waveform which peaks during every cycle. The peak voltage is sufficient to ignite and maintain the mercury arc discharge in the bulb.

As shown in FIG. 1, a ferrite core transformer 115 of the blocking oscillator circuit comprises three separate windings, a main winding 117, a feedback winding 119, which is magnetically coupled to the main winding (both on the primary side of the transformer) and three secondary windings 121. The top terminal of the main winding 117 is connected to the positive terminal of the DC power supply filter capacitors 109, 111 and 113. The other terminal of winding 117 is connected to blocking diode 129. The cathode of diode 129 is connected to the collector terminal of power transistor 123. Capacitors 125 and 127, which are connected across power transistor 123 and diode 129, are snubber capacitors and limit the maximum voltage applied to the power transistor 123 during a turn-off condition. Diode 129 is blocking diode for isolating primary winding 117 so that the oscillating frequency is primarily determined by the magnetizing inductance of the core and the snubber capacitors 125 and 127.

Feedback winding 119 supplies current to drive, the base of power transistor 123 through base resistors 131 and 133. Capacitor 135 is a bypass capacitor for the base drive circuit. The magnitude of this current is monitored by a current regulator circuit consisting of signal transistor 137, blocking diode 139 and resistors 141 and 143. The current regulator circuit provides a measure of load-current regulation for line-voltage variations, circuit components and aging of the lamp. The signal transistor 137 monitors the voltage across current-sensing resistor 143, connected in series with the emitter of power transistor 123. If the voltage across current sensing resistor 143 is greater than the base-to-emitter drop of signal transistor 137, there is a flow of base current to signal transistor 137 turning it on and shunting a portion of the base current of power transistor 123 to ground, thereby reducing the collector current of power transistor 123. Diode 139 prevents the reverse voltage from appearing at the collector of signal transistor 137. Since current regulation depends on the temperature-sensitive base-to-emitter voltage of signal transistor 137, a change in the junction temperature results in a change in load current. Since the load current may vary over wide limits, regulation is adequate using inexpensive temperature-sensitive transistors.

Secondary winding 121 of transformer 115 has two end winding sections, one 151 for a low voltage side filament, and one 153 for a high voltage side filament, both of which are connected to lamp filament electrodes 159 and 161, respectively. The two filament winding sections 151 and 153 provide the filament current necessary to heat the tungsten wire filaments for emitting electrons. Output voltage winding portion 155 between end portions 151 and 153 provides a voltage for igniting and driving the fluorescent lamp 157. Resistors 159 and 161 limit the filament currents.

Operation is as follows. Initially, starting resistors 145 and 147 and capacitor 149 render power transistor 123 conductive by forcing base current into its base via feedback winding 119. Power transistor 123 saturates. When the transformer reaches magnetic saturation, the voltage across feedback winding 119 decreases causing the base current of power transistor 123 to decrease. Transistor 123 quickly returns to its offstate and the electromagnetic energy stored in the core of transformer 115 is now transferred to snubber capacitors 125 and 127 as electrostatic energy. The capacitor voltage now rings with a fundamental frequency determined by the magnetizing inductance of the core and the capacitance of the snubber capacitors. During the period when the snubber capacitor voltage is negative, the transistor remains off. This condition persists until the snubber capacitors discharge, at which point the cycle repeats itself.

During start up, the blocking oscillator circuit produces voltages across filament winding portions 151 and 153. These filament voltages cause heating currents to flow in filament electrodes 159 and 161. The heated filaments 159 and 161 emit electrons which are accelerated by the high open-circuit voltage (approximately 400 volts peak) impressed between the high-voltage and low-voltage filaments 161 and 159, respectively, during each cycle to ignite the lamp. Once the lamp ignites, the mercury arc clamps the lamp voltage to a relatively low value across secondary winding portion 155 to approximately 90 volts peak. This clamping action reduces the filament voltage to a relatively low value, reducing filament currents to approximately 10% of their initial values. This reduction of filament current does not affect the operation of the lamp because the arc energy is now sufficient to provide electrons from the filament by self-heating. Consequently, the lamp remains ignited until the AC power is interrupted.

If, for any reason, the arc is extinguished, the output voltage across winding portion 155 and the filament currents return to their starting values. The increased heating of the filament electrodes, in conjunction with the higher impressed voltage across them, reestablishes the arc and re-ignites the fluorescent lamp.

A characteristic of the solid-state fluorescent lamp circuit described above for the 9-watt lamp is that it has an input volt-ampere relationship that is approximately linear over its entire operating range. The lamp current is approximately proportional to the input line voltage and is given by:

$$I_{lamp}=2.4\times V_{AC}-125,$$

where $I_{lamp}$ is the R.M.S. lamp current in mA and VAC is the input line voltage in volts. The benefit of this relationship is that the fluorescent lamp may be dimmed by varying the line voltage.

Experimental observations have demonstrated that the lamp current can be varied from 176 mA R.M.S. with a line voltage of 129 volts AC down to 2 mA R.M.S. with a line voltage of 53 volts AC. Experiments have also demonstrated that the range of variation of the lamp current is almost 90 to 1, much greater than the 3 to 1 range typically observed with a conventional inductor ballast. The lamp operating frequency is in excess of 30 kHz, well above the audible range, and permits the use of smaller magnetic components.

With reference now to FIG. 2, there is shown an alternate embodiment of the invention using an L-C series resonant circuit. The resonant circuit comprises a series inductor 207 of inductance L in series with capacitor 209 of capacitance C. The current is a maximum and in phase with the applied voltage at the resonant frequency, at which the inductive reactance and the capacitive reactance magnitudes are equal. The shape of the series resonance curve is determined by the circuit Q, the ratio of the inductive reactance $\omega L$ to the circuit resistance R. The voltage across capacitor 209 or inductor 207 is Q times the applied voltage at resonance. For a high Q circuit, this voltage can be many times the applied voltage. It is this high voltage at resonance that ignites the mercury arc across the lamp.

A primary winding 215 of a ferrite core transformer 213 receives current pulses in a manner described below. The AC rectifier circuit comprising full-wave bridge rectifier 203 and filter capacitor 205 receives the 120 VAC applied to its input terminals. Filter capacitor 205 charges to an average DC voltage of approximately 140 volts. Power resistor 201 limits current surges at turn-on and also helps in decreasing the ripple factor of the output waveform. Power MOSFET 221 switches that DC voltage across terminals A and B to primary winding 215. An ultra-fast rectifier diode 223 across power MOSFET 221 prevents the relatively slower MOSFET diode from conducting during the negative half-cycle of the current. Snubber resistor 225 and snubber capacitor 227 limit the peak voltage across the MOSFET 221. Capacitor 229 provides a low impedance path for high frequency currents.

A CMOS oscillator drives MOSFET 221 at the required resonant frequency (preferably 40 kHz). The oscillator comprises CMOS inverters 231 and 233 in conjunction with timing elements 235, 237, 239 and 241 connected as shown. The output of the inverter 233 is buffered by inverters 243, 245, 247 and 249 to boost the oscillator's current capacity, and consequently switch the MOSFET on and off as rapidly as possible.

The oscillator is powered by a low DC voltage power supply (+15 volts) developed from terminals A and B by series-dropping resistor 257. Zener diode 259 and filter capacitors 261 and 263 complete this low voltage supply.

Operation is as follows. Turning on the lamp energizes the DC power supply and the oscillator circuit. Filament secondary windings 217 and 219 on the secondary side of the transformer 213 provide the lamp filament current to heat the tungsten wire filaments 253 and 255 for the emission of electrons. Output voltage winding 211 of transformer 213 provides an AC voltage at the resonant frequency of the resonant circuit formed by inductor 207 and capacitor 209, applied to this resonant circuit. The voltage developed across capacitor 209 is Q times the applied voltage and is applied across fluorescent lamp 251, igniting the lamp. The ignited arc clamps the voltage across capacitor 209 to approximately 70 volts. The low resistance of the conducting arc lowers the Q of the resonant circuit, thereby limiting the voltage on capacitor 209. The lamp remains lit until the 120 volt AC power is interrupted.

If for any reason the arc is extinguished, the voltage across capacitor 209 immediately rises to the starting value, re-establishing the arc and re-igniting the fluorescent lamp.

The operating characteristic for dimming of this solid state circuit is similar to the previous circuit shown in FIG. 1 in that it has an input volt ampere relationship that is approximately linear over its entire operating range. Experiments have demonstrated the range of lamp current variation to be 30 to 1.

Other embodiments are within the following claims:

We claim:

1. Apparatus for energizing a fluorescent lamp having two filament electrodes comprising, a rectifier circuit responsive to an AC voltage for providing DC voltage, a transformer having at least a primary winding and secondary winding means for providing transformed power to said lamp, switching means for intermittently connecting said DC voltage to said primary winding to develop current pulses at an ultrasonic frequency, said switching means comprising a power transistor for providing a voltage waveform at the primary winding having peaks during every cycle, and a blocking diode for selectively isolating the primary winding form the power transistor, means for coupling said secondary winding means to said filament electrodes to both heat said filament electrodes and establish a potential thereacross for initiating and maintaining an arc therebetween said transformer including a feedback winding, said power transistor including a base, and a starting circuit having a resistor in series with a capacitor connected to said rectifier circuit and coupled through said feedback winding to said base to initially render said power transistor conductive, wherein the switching means comprises, a power MOSFET used as an on and off switch, a CMOS oscillator circuit oscillating at said switching frequency for controlling the state of the power MOSFET, and a snubber circuit for limiting the peak voltage across the power MOSFET.

2. Apparatus in accordance with claim 1 wherein said secondary winding means comprises, a low voltage filament winding connected to one of the filament winding connected to one of the filament electrodes for inducing current to flow through that filament electrode, a high voltage filament winding connected to the other filament electrode for inducing current to flow through that filament electrode, and an output winding for establishing an ignition potential between the filament electrodes.

3. Apparatus in accordance with claim 1 wherein the switching means further comprises a blocking diode for selectively isolating the primary winding from the power transistor.

4. Apparatus in accordance with claim 1 wherein the switching means further comprises a current regulator circulator for regulating the current through the power transistor

5. Apparatus in accordance with claim 1 wherein said transformer comprises, a main winding comprising said primary winding having a first terminal connected to the rectifier circuit and a second terminal connected to said switching means,.

and a feedback winding having a first terminal connected to said switching means circuit for controlling switching and a second terminal connected to said secondary winding means.

* * * * *